United States Patent [19]

Hamm

[11] Patent Number: 4,881,351

[45] Date of Patent: Nov. 21, 1989

[54] SELF-SUPPORTING UNIT ELEMENT STAIRCASE

[76] Inventor: Wilfred Hamm, D-4330 Mulheim-Ruhr, Im, Wiesenggrund 28, Fed. Rep. of Germany

[21] Appl. No.: 149,130

[22] Filed: Jan. 27, 1988

[30] Foreign Application Priority Data

Jan. 27, 1987 [DE] Fed. Rep. of Germany ..... 3702278

[51] Int. Cl.[4] ..... F04F 11/02

[52] U.S. Cl. ..... 52/182; 52/187

[58] Field of Search ..... 52/182, 187; 182/106, 182/180, 195, 228

[56] References Cited

U.S. PATENT DOCUMENTS 705,794 7/1902 Snider ..... 52/187
990,701 4/1911 Burge ..... 182/106 X
4,041,662 8/1977 Ward ..... 52/182 X
4,250,977 2/1981 Deli ..... 182/106 X

*Primary Examiner*—David A. Scherbel
*Assistant Examiner*—Anthony W. Williams

[57] ABSTRACT

Self-supporting unit element staircase consisting of linking elements of steel tube shaped by bending into a U-form and which lie at right angles to the line of the stairs. These linking elements are connected together at their upper, open ends by means of handrail parts, which are also of steel tube and have been shaped by bending and which have a coupling sleeve welded on transversely at one end. At their lower ends, the linking elements are connected together by means of the steps, which have pipe clamp fittings at their four corners. Two different step shapes permit every desired form of flight of stairs to be constructed.

7 Claims, 5 Drawing Sheets

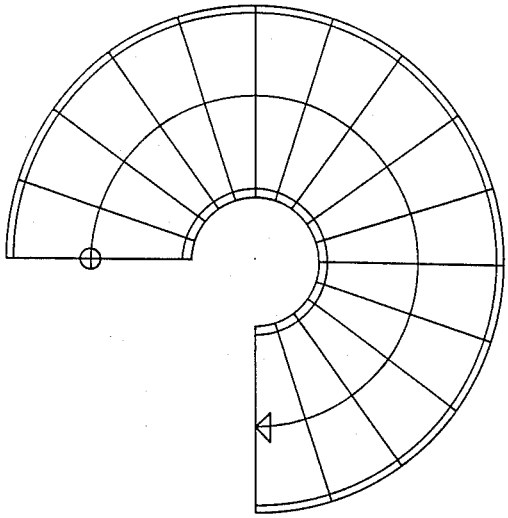
FIG. 1
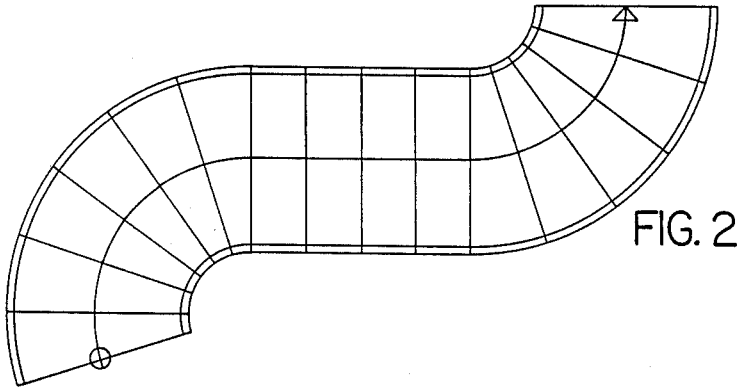
FIG. 2
FIG. 3
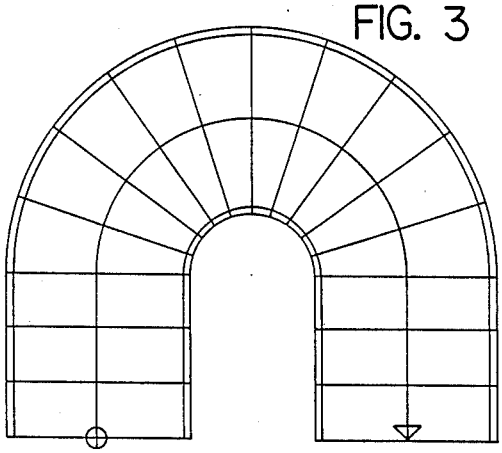

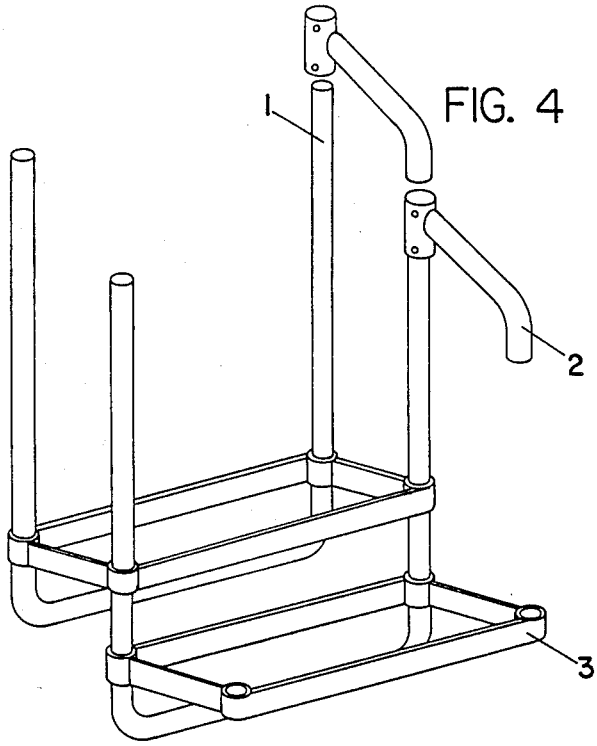
FIG. 4
FIG. 5
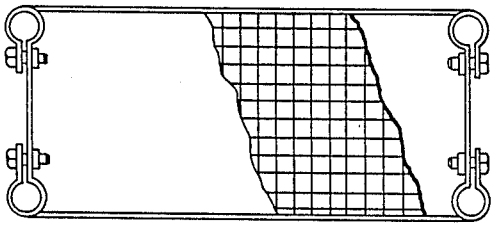
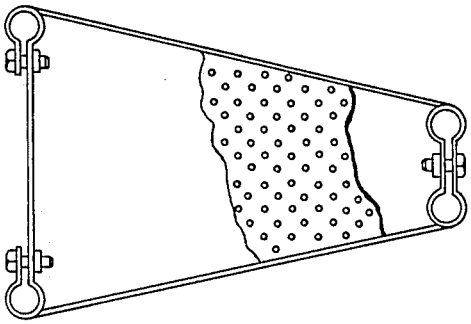
FIG. 6

SELF-SUPPORTING UNIT ELEMENT STAIRCASE

The invention concerns a self-supporting unit element staircase, preferentially used as an outside staircase, as used both to permit access to parts of industrial plant and as fireescape staircase for hotels and other large buildings as well as outside staircases in domestic dwellings.

Up to the present time such staircases have always had to be individually matched to each particular case of application. In addition, the officially prescribed live load of 5 $KN/m^2$ cannot be met by normal standard stairs so that high costs were always associated with such stairs.

In addition, the newelled staircases known to date in which all the steps are secured to one central tube can only be used in certain circumstances since the statics of such staircases come up against insurmountable obstacles when large height differences have to be overcome. The staircase described in German Patent Application P 3637807 certainly avoids the abovenamed disadvantages but is still too material-intensive in terms of its design.

The aim of this invention is to create a staircase for the cases of application described above which is capable of being manufactured and erected economically, which requires only a small amount of material and which can be used for practically every application where a flight of stairs is needed without thereby special designs/versions being required.

In the invention, the aim is solved by means of a steel tube construction consisting of U-shaped linking elements, handrail parts which are placed on the upper ends of the linking elements and steps which are attached to the lower ends of the linking elements by means of clamping joints.

Further characteristics of the invention lie in the fact that a total of only three elements, namely linking element, handrail part and step, are needed to permit a complete staircase to be realized, and that, with just five series parts, namely linking element, outside handrail part, inside handrail part, radiussed step for circular sections and straight step for straight sections, every desired shape of staircase can be manufactured.

The nature of the invention is made clear with drawings.

FIG. 1 shows the typical form of the flight of stairs in a circular staircase. Four constructional elements, namely step, linking element, outside handrail part and inside handrail part, are sufficient for the manufacture of this flight or stairs.

FIGS. 2 and 3 show flights of stairs which contain all possible variants. In addition to the element of the circular staircase, which is already present and which is used for all radial parts of the staircase, all that is needed extra here is the step for the straight sections of staircase in order to cover these.

FIG. 4 shows a perspective view of two staircase elements joined together.

FIG. 5 shows the step for the straight sections of staircases and FIG. 6 the step for circular sections.

Figure 8:
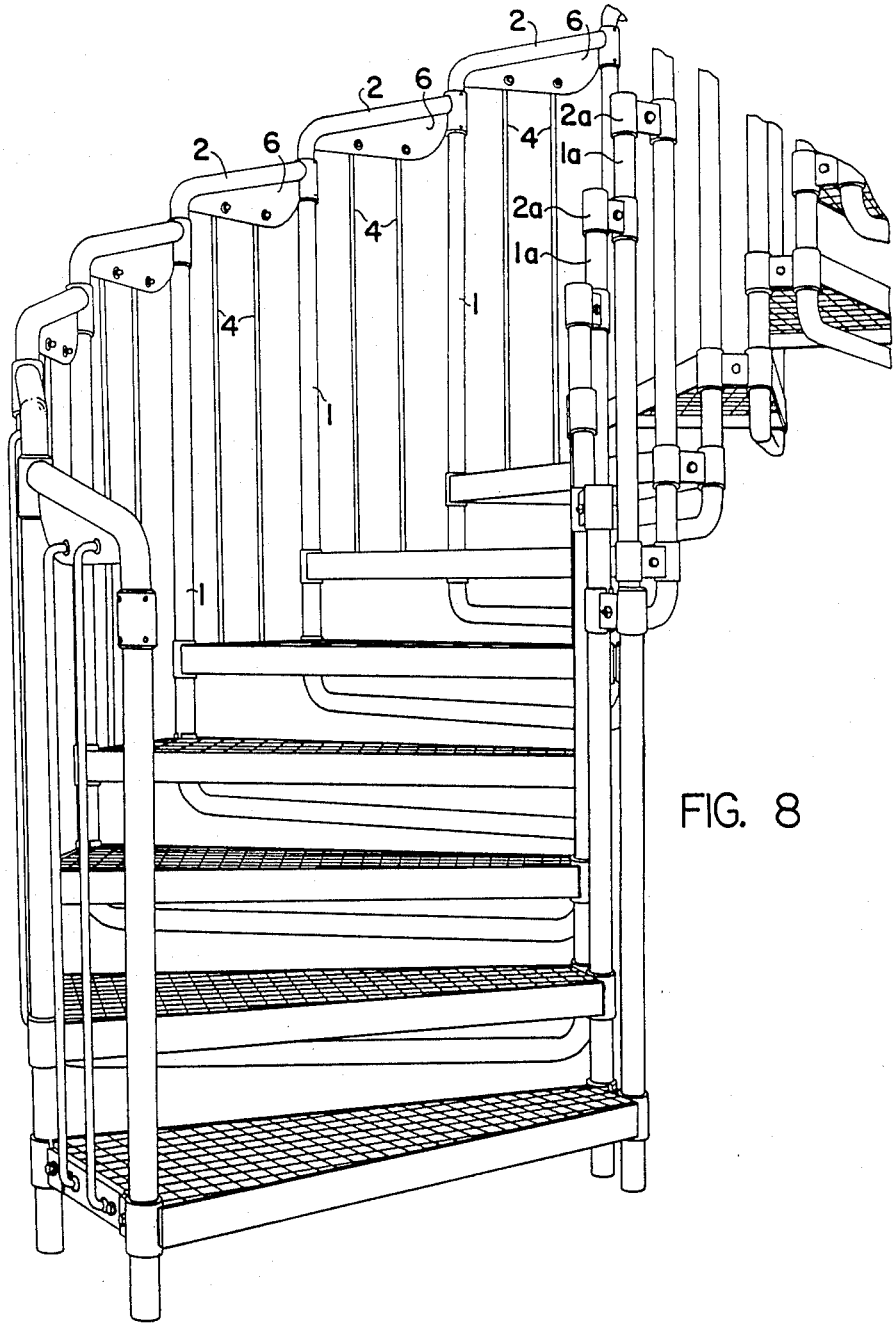
FIG. 8 shows an assembled staircase made up from components such as those shown in FIG. 7.

Each step has a U-shaped element (1) formed from steel tubing. A handrail defining part (2) is secured to the end of at least one leg of this U-shape element (1). A straight staircase would have such a handrail part (2) on both legs (See FIG. 4) whereas FIG. 8 shows the inner legs (1*a*) of an arcuate staircase without any handrail. These inner legs (1*a*) are joined by a short clamp member (2*a*) not unlike the right hand end of the stair shown in FIG. 6.

The handrail part (2) has a gusset plate (6) that supports the upper ends of balusters (4). The lower ends of these balusters (4) are secured to the step as best shown at the left hand end of the lowermost step in FIG. 8. A plate is preferably provided at the lower ends of these balusters (4) to more conveniently secure them to the left hand end of the step of FIG. 6.

Figure 7:
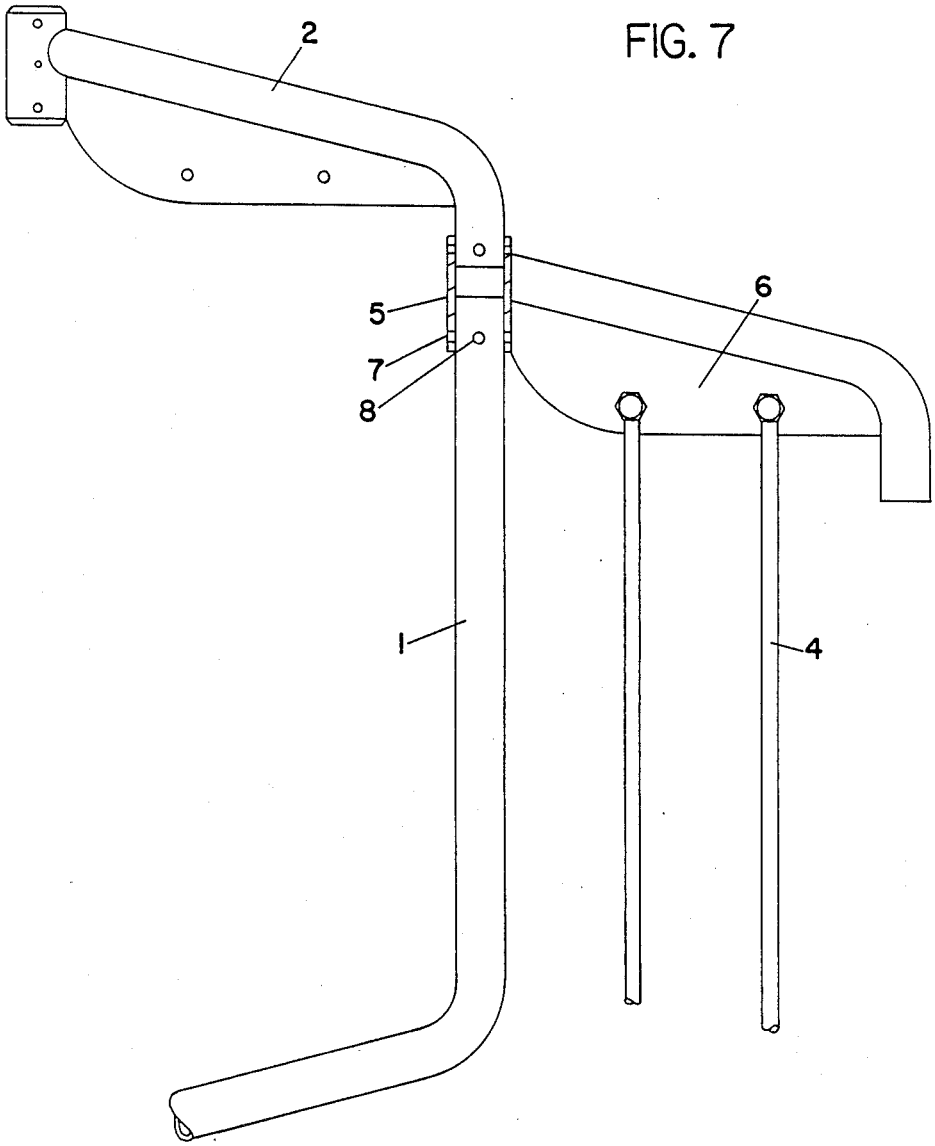
FIG. 7 shows in enlarged form the handrail parts which are placed on to the upper end of the linking elements and also shows the way in which these handrail parts are secured.
Figure 9:
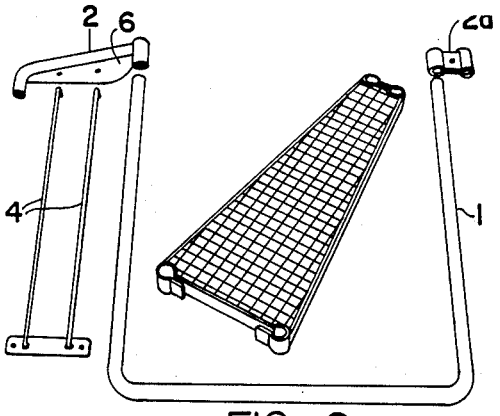

FIG. 9 shows the component parts for the staircase of FIGS. 7 and 8.

Figure 10:
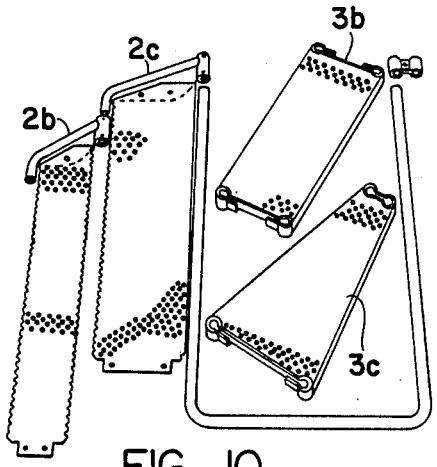
Figure 11:
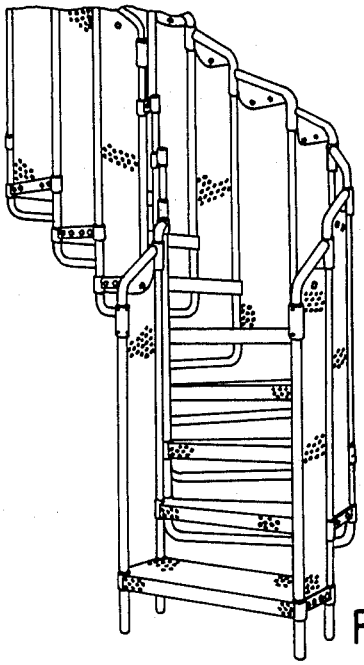

FIG. 10 shows the components parts for the staircase of FIG. 11. Note that two different size handrail parts (2*b*) and (2*c*) are provided for utilizing either the rectangular step 3(*b*) or the arcuate staircase step (3*c*). The perforated plates of handrail parts (2*b*) and (2*c*) provide a different impression from that of the FIGS. 7–8 staircase but the basic staircase constructions are nevertheless quite similar to one another.

The central component of the staircase is the linking element (1). This is of steel tube and is shaped by bending into the necessary U-shape. The linking elements are joined to one another at their upper ends by the handrail parts (2) and at their lower ends by means of steps (3). The handrail parts (2) are also of steel tube and have been bent into that shape and are of that size which is required to give the desired pitch to the stairs; they have a coupling sleeve (5) welded on transversely at one end. Into this coupling sleeve are stuck from below the linking element (1) and from above the free end of the next handrail part.

The free space in the axial direction provided for in the design between the two tube ends inserted into each coupling sleeve enable the variations in the height of the stairs arising at erection to be compensated for. Set screws (7) aid the adjustment work and spring-type slotted straight pins (8) give to the union the necessary ability to be loaded statically. Hereby all that has to be done is to bore holes with a hand drill through the ends of the tubes which have been stuck into the coupling sleeves using as a line the holes which are already present in the coupling sleeves (5).

The steps (3) consist of a frame of flat steel which has been put into the form of a pipe clamp fitting at each of its four corners. These pipe clamps grip the lower part of a pair of linking elements and ensure an especially rigid connection when the three or, respectively four pipe clamp screws are tightened up. Two shapes of step are used, the particular one being used at any point depending on the shape of the staircase desired at that point. The straight step (FIG. 5) is used for the straight parts of a flight of stairs and the radiussed step (FIG. 6) for the circular parts. Hereby the frame of the steps can be filled in with gridiron, perforated plate, bulb plate, stone, wood or plastic coverings. The symmetry of the radiussed step means that it can be used both for clockwise as well as for anticlockwise circular staircases.

A plate (6) welded to the handrail part (2) serves as the mounting point for the top of the rail balbusters (4), the bottom end of these being secured to the steps. This represents only one of a large number of different possibilities. Thus the side of the staircase could also be covered in completely with perforated plate etc.

The simplicity of the parts and the small number of these mean that the staircase can be erected very rapidly without any refashioning bending work being necessary. Thus special surface treatments of the finished steel tube and step elements can be carried out before a staircase is erected since the parts are fully prefabricated individual parts.

The very small amount of material used and the very small transport weight, the maximum possible stability and the simple method of erection without refashioning make this staircase into a particularly economical product. In addition, the simple function shape and the predominance of the shaped steel tube as the constructional material lend to the staircase an attractive design.

I claim:

1. A staircase comprising a plurality of U-shaped supporting elements, each element having a horizontally extending base and vertically upwardly extending legs integrally connected to the base, a plurality of steps having opposed ends and marginal edges between said opposed ends and said marginal edges are longer than said opposed ends, means for clamping said step ends of each step to the legs of at least two of said U-shaped elements so that each step is supported above both bases of said two U-shaped elements with said step marginal edges parallel said elements bases, said U-shaped elements being spaced vertically one relative to another so as to define a predetermined pitch or rise for successive steps in the staircase.

2. The staircase according to claim 1 wherein said U-shaped supporting elements are tubular in cross section and wherein said means for clamping said step ends to said U-shaped element legs comprises means for encircling said tubular element legs.

3. The staircase according to claim 1 further comprising handrail defining parts, said U-shaped supporting element legs having upper ends, and means coupling said handrail defining parts to said element leg upper ends.

4. The staircase according to claim 3 wherein at least some of said steps having non-rectangular generally trapezoidal shape, said supporting elements and steps defining a non-linear staircase.

5. The staircase according to claim 3 wherein said handrail defining parts include vertically extending side parts extending from one end of at least one step to said handrail defining part.

6. The staircase according to claim 3 wherein said handrail defining parts are secured to the upper ends of said upwardly extending legs, and said clamping means defined integrally at the ends of said steps whereby only said handrail defining parts, said steps, and said U-shaped supporting elements are required to assemble a complete staircase and handrail according to the present invention.

7. The staircase according to claim 1 further comprising handrail defining parts that are so shaped as to define said desired pitch or rise of the staircase steps, each of said handrail parts being defined by a coupling sleeve adjacent one end of the handrail part and adapted to be received on the upper end of the U-shaped supporting leg, and each handrail part including an opposite end adapted to be received in the coupling means of an adjacent handrail part.

* * * * *